United States Patent [19]

Hargrave

[11] Patent Number: 5,023,989

[45] Date of Patent: Jun. 18, 1991

[54] TOOL FOR REPAIRING POP-UP SPRINKLERS

[76] Inventor: David L. Hargrave, 5036 Walmar Ave., La Canada, Calif. 91011

[21] Appl. No.: 440,992

[22] Filed: Nov. 22, 1989

[51] Int. Cl.[5] ..... B25B 7/12

[52] U.S. Cl. ..... 29/426.5

[58] Field of Search ..... 29/268, 234, 235, 237, 29/426.5; 81/302, 421–424

[56] References Cited

U.S. PATENT DOCUMENTS

| | | | |
|---|---|---|---|
| 159,508 | 2/1875 | Gray . | |
| 198,678 | 12/1877 | Poole . | |
| 464,860 | 12/1891 | Duvall . | |
| 891,061 | 6/1908 | Hansen | 81/302 |
| 1,122,165 | 12/1914 | Schoening . | |
| 1,810,631 | 12/1929 | Trump | 81/302 |
| 1,862,273 | 4/1930 | McGuckin . | |
| 2,532,141 | 11/1950 | Barkan et al. . | |
| 2,792,622 | 5/1957 | Wurzel | 81/302 |
| 3,823,462 | 7/1974 | Kanda . | |
| 4,106,374 | 8/1978 | Dragan | 81/302 |
| 4,573,339 | 3/1986 | Emery | 81/302 |

*Primary Examiner*—Robert C. Watson

*Attorney, Agent, or Firm*—Jeffrey G. Sheldon

[57] ABSTRACT

A hand tool is useful for extracting upwardly a shaft of a pop-up sprinkler that is biased downwardly into a cavity in the sprinkler and for maintaining the shaft in an extracted position. The tool comprises a pair of elongated members pivotally connected to each other at a pivot point to form a pair of opposed handles and a pair of opposed grippers. Biasing means are provided for biasing the grippers together. Each gripper has a projection extending outwardly from its nose end for gripping an inside wall of the shaft. Each gripper also includes a cut-out portion on its inside surface so that the two cut-out portions form an opening shaped to firmly grip the outside wall of the extracted sprinkler shaft. When the tool is placed on the sprinkler shaft, due to the force of the biasing means, the tool firmly grips the sprinkler shaft and prevents it from dropping downwardly into the recess.

8 Claims, 1 Drawing Sheet

TOOL FOR REPAIRING POP-UP SPRINKLERS

BACKGROUND

This invention is directed a tool for installing and repairing pop-up sprinklers.

Pop-up sprinklers are becoming increasingly popular for irrigation requirements. They have significant advantages compared to conventional fixed sprinklers. For example, because they are recessed, pop-up sprinklers are less likely to be damaged by equipment such as lawn mowers. Moreover, they are less likely to cause injury to users of an irrigated facility. On sports fields, a fixed, above grade sprinkler can be a hazard to users of the field.

Another advantage of pop-up sprinklers is that they are less susceptible to vandalism and inadvertent damage than above grade sprinklers. A sprinkler located along sidewalks and driveways can inadvertently be damaged by pedestrians or vehicles.

A problem with pop-up sprinklers compared to conventional fixed sprinklers is that they are more difficult to repair and install. Pop-up sprinklers conventionally include a spring biasing the sprinkler shaft downwardly into a cavity. When water is turned on, the water pressure forces the sprinkler shaft upwardly so that it is above grade and can discharge water for irrigation. It is very difficult to manually raise the shaft against the force of the retraction spring. Even once the shaft is raised, the repairman or installer needs to use one hand to hold the shaft raised, and thus has only one hand available for repair and adjustment. Thus pop-up sprinklers are very frustrating to repair, take more time, and are more costly to repair than conventional fixed sprinklers.

Accordingly, there is a need for a tool and a method that will allow installers and repairmen to work with pop-up sprinklers in the same manner that they can work with conventional sprinklers.

SUMMARY

The present invention is directed to a hand tool satisfying this need. The tool is for use with a pop-up sprinkler that has a pop-up shaft, the shaft comprising an outside wall and a recess having an inner wall. The tool is useful for extracting the shaft upwardly against a biasing force and for maintaining the shaft in an extracted position.

The tool comprises a pair of elongated members or shafts pivotally connected to each other at a pivot point to form a pair of opposed handles and a pair of opposed grippers or jaws. Pivoting the handles together causes the grippers to pivot apart. The tool also includes a biasing means for biasing the handles apart and the grippers together. The biasing means can be a spring attached to the handles. Each gripper comprises an inner surface proximate to the other gripper and an opposed outer surface distal from the other gripper. Each outer surface includes a nose section distant from the pivot point sized to fit into the recess of the sprinkler shaft when the grippers are together. Each gripper also includes a projection projecting outwardly from the outer surface of the tip of the nose section for gripping the inside wall of the shaft recess. Each gripper also has a cut-out portion on the inside surface shaped so that the opposed cut-out portions of the grippers form an opening shaped to firmly grip the outside wall of an extracted sprinkler shaft. Preferably, the cut-out portions form a generally ellipsoidal opening for accommodating different sized sprinkler shafts.

With this tool, pressing the handles together with the grippers inserted into a pop-up sprinkler causes the projections to firmly grip the inside wall of the sprinkler shaft recess so that the shaft can be extracted. After the sprinkler shaft is extracted, placement of the cut-out portions of the grippers on the body of the extracted sprinkler shaft firmly holds the shaft extracted because of the biasing means, without any assistance from the user of the tool.

Preferably the tool includes limit means such as a set screw for limiting the distance the grippers can be pivoted apart from each other.

For ease in inserting the noses of the grippers into the sprinkler shaft recess, preferably the outer surfaces of the nose sections of the grippers slope toward each other and become progressively closer to each other toward their tips. Also, preferably each projection is normal to its respective outside surface and is formed to have a sharp edge.

This hand tool is a simple, inexpensive device that serves two functions much needed in the industry and by home owners. It not only allows a pop-up sprinkler shaft to be extracted from a recess extremely easily, but also holds the sprinkler shaft extracted without any assistance from the user so that both hands of the user are free for repair, maintenance, and installation of the sprinkler.

DRAWINGS

These and other features, aspects, and advantages of the present invention will become better understood with reference to the following description, appended claims, and accompanying drawings where:

DESCRIPTION

Figure 1:
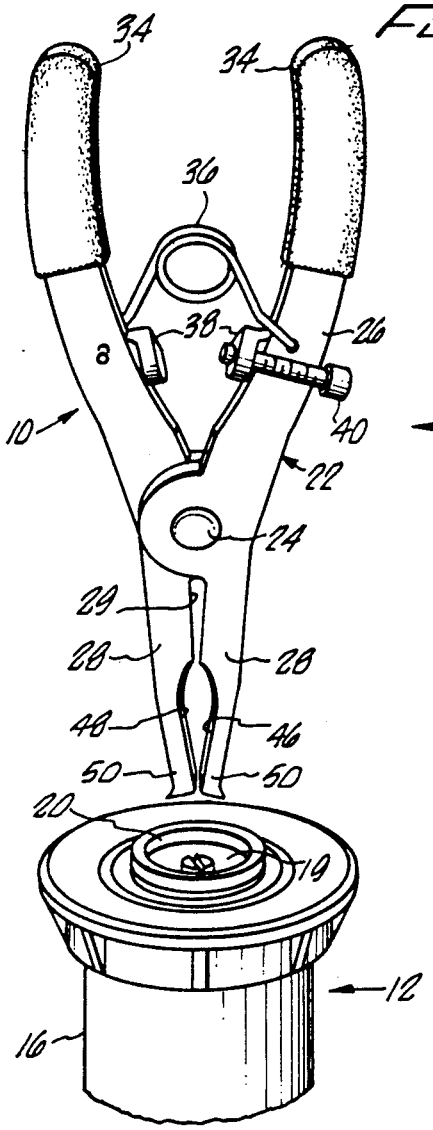
FIG. 1 is a front elevation view of a tool according to the present invention positioned above a pop-up sprinkler.

With reference to the figures, a hand tool 10 according to the present invention is used with a pop-up sprinkler 12. The pop-up sprinkler 12 typically includes a shaft 14 that is biased by a spring (not shown) downwardly into the main body 16 of the sprinkler. The shaft 14 has an outside wall 18, and a recess 19 having an inside wall 20.

Figure 4:
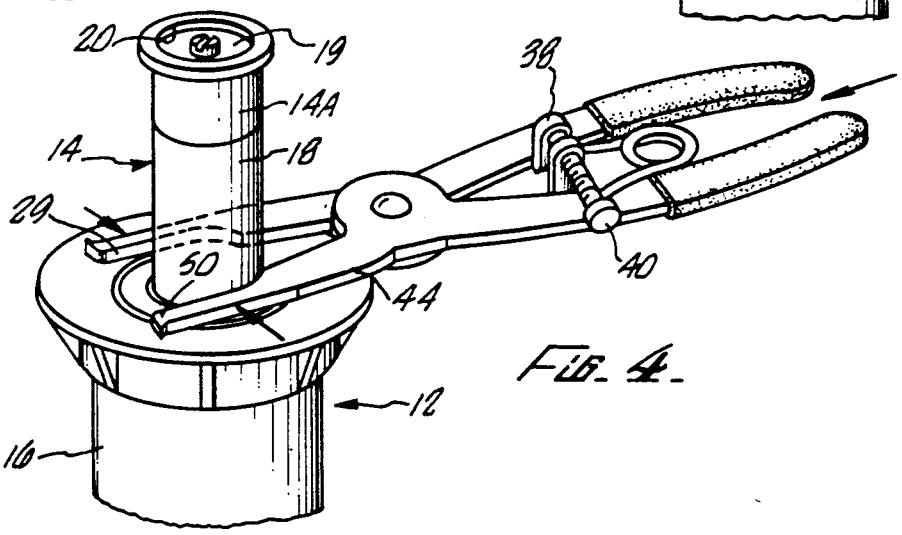
FIG. 4 is a perspective view showing the tool of FIG. 1 being used for retaining the shaft of the sprinkler of FIG. 1 in an extracted position.

As used herein, the term "shaft" is used broadly and includes a shaft with a nozzle attached thereto. For example, as shown in FIG. 4, the shaft 14 includes a removable nozzle section 14A. The term "shaft" also includes an impulse sprinkler with a top thereon, where the tool is used to pull on the cap to extract the impulse sprinkler.

The tool 10 comprises a pair of elongated members 22 pivotally connected to each other by a rivet 24 at a pivot point, thereby forming a pair of opposed handles 26 and a pair of opposed, elongated grippers or jaws 28.

The members 22 are identical, being positioned with the gripping faces 29 adjacent to each other. When the handles 26 are pivoted together as shown by arrows 30 in FIG. 2, the grippers 28 pivot apart as shown by arrows 32 in FIGS. 2 and 3. Preferably the handles 26 are provided with a plastic coating 34 for ease in gripping the handles, particularly when the user's hands are wet as can occur when working on sprinkler systems.

The tool also includes a coil spring 36 attached to each handle 26 for biasing the handles 26 apart and thus the grippers 2 together.

Each handle 26 is provided on its inside surface with a lug 38 extending in a direction normal to the pivot plane of the handles. One of the lugs has a threaded hole therethrough for receiving a set screw 40 whose position is adjustable in the lug by threading it in and out to vary the distance between the end of the set screw and the opposing lug 38. This limits the distance that the handles 26 can be pivoted together and thus the distance that the grippers 28 ca be spread apart.

Each gripper 28 has its inner gripping surface 29 proximate to the other gripper, and an opposed outer surface 44 distal from the other gripper. Each inner surface has a cut-out portion 46 shaped and located so that the opposed cut-out portions 46 form an opening 48 shaped to firmly grip the outside wall 18 of the extracted sprinkler shaft 14 as shown in FIG. 4. As detailed below, this allows the gripper shaft to be retained in an extracted position "hands-free", where the user does not have to use his hands to keep the sprinkler shaft extracted.

Preferably the cut-out portions 46 are sized so that the opening 48 is ellipsoidal, skewed toward the handles, to accommodate different size sprinkler shafts.

Figure 3:
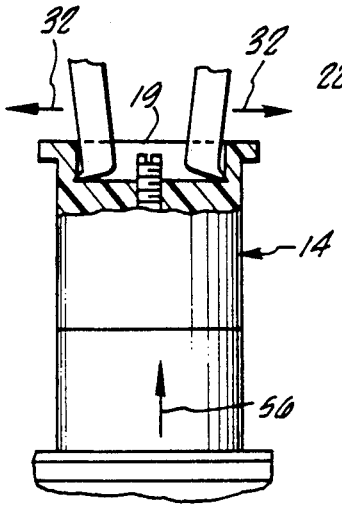
FIG. 3 shows in detail the engagement of the nose of the tool of FIG. 2 with the inside wall of the shaft of the sprinkler of FIG. 1.

For extracting the sprinkler shaft 14, each gripper includes a nose section 50 sized to fit into the sprinkler shaft recess 19 when the grippers 28 are together. A projection or tooth 52 projects outwardly from the outer surface 44 of the tip or end 54 of the nose section 50. As shown in FIG. 3, this tooth 52 is used to engage and grip the inside wall 20 of the sprinkler shaft 14. Preferably each tooth 52 extends substantially normal to its respective outer surface 44. The tooth 52 can be a single tooth extending across the width of the outer surface 44 of the gripper 28 or can be a plurality of teeth.

Figure 2:
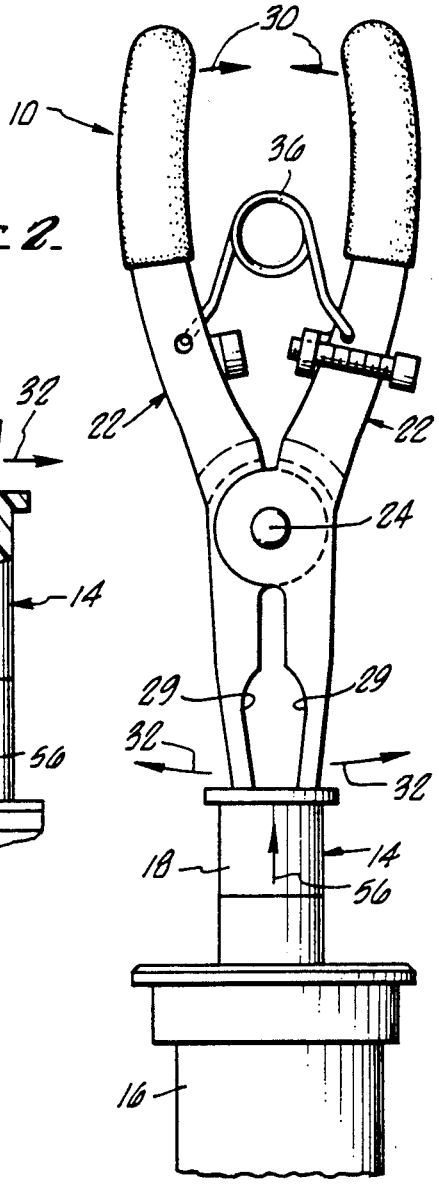
FIG. 2 shows the tool of FIG. 1 being used for extracting the shaft of the pop-up sprinkler of FIG. 1 from its recess.

Preferably the outer surfaces 44 of the nose sections 50 slope toward each other, both when the grippers are together as shown in FIG. 1, and when they are spread apart as shown in FIG. 2. This makes it easy to insert the grippers into the sprinkler shaft recess 19.

The tool 10 is simple and easy to use. As shown in FIGS. 1, 2, and 3, the nose of the tool is inserted inside the sprinkler shaft. The handles 26 are then pressed together as shown by arrow 30, thereby spreading the grippers 28 so that the teeth 52 firmly engage the inside wall 20 of the shaft recess 19. With the teeth so engaged, the tool 10 is pulled upwardly as shown by arrow 56 in FIGS. 2 and 3.

With the shaft 14 so extracted, the handles 26 are released, thereby disengaging the teeth 52 from the shaft recess 19. The user, while holding the shaft 14 extracted with one hand, removes the tool 10 from the shaft with the other hand.

As shown in FIG. 4, the handles are then pressed together, limited by the set screw stop 40, and the grippers 28 are placed around the extracted shaft 14. Because of the biasing spring 36, when the handles 26 are released, the grippers 28 firmly grasp the shaft and keep it from retracting back into the sprinkler body 16. Thus both hands of the user are free for repair or adjustment of the sprinkler 12.

The tool 10 can be made of a variety of materials, but preferably for durability, the elongated members 22 are formed of cold rolled steel No. 1010 confirming to ASTM standard A-366. The members 22 are tempered or carburized case hardened from 0.005 to 0.01 depth, providing a hardness of from 58–60 on the Rockwell scale. The rivet 24 can be made of 304 stainless steel, which is applied after case hardening. The handle grips 34 are preferably made of polyvinylchloride material, having a 75 Shore A durometer hardness, with a wall thickness of from 0.04 to 0.06 inch. Preferably the spring is 0.075 gauge piano wire coiled into a torsion spring configuration.

Although the present invention has been described in considerable detailed with reference to certain preferred versions thereof, other versions are possible. Therefore the spirit and scope of the appended claims should not be limited to the description of the preferred versions contained herein.

What is claimed is:

1. A method for adjusting and repairing a pop-up sprinkler having a shaft biased downwardly into a cavity in the sprinkler, the sprinkler shaft comprising an outside wall and a recess having an inside wall, the method comprising the steps of:

(a) selecting a hand tool comprising:

(i) a pair of elongated members pivotally connected to each other at a pivot point to form a pair of opposed elongated handles and a pair of opposed grippers, wherein pivoting the handles together causes the grippers to pivot apart;

(ii) biasing means for biasing the handles apart and the grippers together; and wherein (iii) each gripper comprises:

a) a tip at its end;

b) an inner surface proximate to the other gripper;

c) an opposed outer surface distal from the other gripper, each outer surface including a nose section distant from the pivot point and sized to fit into the shaft recess when the grippers are together;

d) a projection projecting outwardly from the outer surface of the tip of the nose section for gripping the inside wall of the sprinkler shaft; and e) a cut-out portion on the inner surface shaped so that the opposed cut-out portions of the grippers form an opening shaped to firmly grip the outside wall of the extracted sprinkler shaft;

(b) extracting the sprinkler shaft upwardly from the recess by inserting the grippers into the shaft recess with the grippers closed, pressing the handles together to open the grippers so that the projections firmly grip the inside wall of the shaft recess, and pulling the tool upwardly; and (c) maintaining the shaft in its extracted position with the tool by releasing the handles so that they are biased by the spring into an open position so that the grabbers can be removed from the inside of the shaft recess, then removing the tool from the inside of the shaft recess, pressing the handles together a sufficient amount to open the grabbers so that the grabbers can fit around the sprinkler shaft with the sprinkler shaft located in the opening, and then releasing the handles so that the biasing means biases the grabbers firmly against the extracted shaft.

2. The method of claim 1 wherein the step of selecting comprises selecting a hand tool that includes limit means for limiting the distance the grippers can be pivoted apart from each other.

3. The method of claim 1 wherein the step of selecting a hand tool comprises selecting a hand tool where the biasing means comprises a spring attached to the handles.

4. The method of claim 1 wherein the step of selecting a hand tool comprises selecting a second hand tool wherein the cut-out portions of the grippers form a generally ellipsoidal opening to accommodate different sized sprinkler shafts.

5. The method of claim 2 wherein the step of selecting a hand tool comprises selecting a hand tool wherein each projection on the tip of the nose section is substantially normal to its respective outer surface.

6. The method of claim 1 wherein the step of selecting a hand tool comprises selecting a hand tool such that when the grippers are in contact with each other, the outer surfaces of the noise section slope towards each other and become progressively closer to each other towards the tips of the grippers for ease of insertion into the sprinkler shaft recess.

7. The method of claim 6 wherein the step of selecting a hand tool comprises selecting a hand tool that when the grippers are spaced apart a sufficient amount to extract a sprinkler shaft, the outer surfaces of the nose section slope towards each other.

8. The method of claim 6 wherein the step of selecting a hand tool wherein each projection on the tip of the nose section is substantially normal to its respective outer surface.

* * * * *